US005695186A

United States Patent [19]

Phillips et al.

[11] Patent Number: 5,695,186

[45] Date of Patent: Dec. 9, 1997

[54] APPARATUS AND METHOD FOR COLLATING RANDOM ARRAYS OF SHEETS TO ORDERED STACKS

[75] Inventors: Bradley Allen Phillips, Honeoye Falls; Jeffrey Allen Wellman; Craig Andrew Caprio, both of Rochester, all of N.Y.

[73] Assignee: Eastman Kodak Company, Rochester, N.Y.

[21] Appl. No.: 584,657

[22] Filed: Jan. 11, 1996

Related U.S. Application Data

[63] Continuation of Ser. No. 310,560, Sep. 22, 1994, abandoned.

[51] Int. Cl.[6] ..... B65H 9/16

[52] U.S. Cl. ..... 271/252; 271/202; 271/250; 271/251; 271/270; 271/314

[58] Field of Search ..... 271/250, 251, 271/252, 69, 314, 202, 270; 198/394, 460

[56] References Cited

U.S. PATENT DOCUMENTS

| | | | |
|---|---|---|---|
| 458,945 | 9/1891 | Crane et al. . | |
| 2,674,456 | 4/1954 | Gibson, Jr. | 271/52 |
| 3,084,931 | 4/1963 | Hanson | 71/52 |
| 3,630,607 | 12/1971 | Korn et al. | 355/6 |
| 3,669,447 | 6/1972 | Turner et al. | 271/53 |
| 3,840,223 | 10/1974 | Nakata | 271/250 |
| 3,929,327 | 12/1975 | Olson | 271/250 |
| 3,970,299 | 7/1976 | Berger, Jr. et al. | 271/250 |
| 4,060,237 | 11/1977 | Degen et al. | 271/250 |
| 4,072,228 | 2/1978 | Honegger et al. | 271/202 |
| 4,133,523 | 1/1979 | Berthelot | 271/202 |
| 4,143,755 | 3/1979 | Keller | 271/250 |
| 4,201,377 | 5/1980 | Honegger | 271/225 |
| 4,248,151 | 2/1981 | Real | 101/288 |
| 4,349,188 | 9/1982 | Young | 271/225 |
| 4,374,586 | 2/1983 | Lamos et al | 271/250 |
| 4,456,116 | 6/1984 | Jarman | 271/251 |
| 4,546,964 | 10/1985 | Linthout | 271/250 |
| 4,585,227 | 4/1986 | Müller | 271/202 |
| 4,629,177 | 12/1986 | Roddeman et al. | 271/240 |
| 5,162,857 | 11/1992 | Higeta et al. | 271/251 |
| 5,280,903 | 1/1994 | Herrick, Jr. | 271/251 |

FOREIGN PATENT DOCUMENTS

| | | | |
|---|---|---|---|
| 3724713 A1 | 3/1988 | Germany | B65H 9/00 |
| 26741 | 2/1983 | Japan | 271/250 |
| 109344 | 5/1983 | Japan | 271/250 |
| 56-205191 | 6/1983 | Japan | B65H 9/16 |

*Primary Examiner*—William E. Terrell
*Assistant Examiner*—Khoi H. Tran
*Attorney, Agent, or Firm*—Clyde E. Bailey, Sr.

[57] ABSTRACT

Sheet collation apparatus and method operate on a random array of seriatim sheets to effect ordered stack collation. An edge guide surface is located along a sheet support surface extending from a sheet ingress to egress. A plurality of conical rollers are configured and relatively overdriven to effect edge alignment and sheet end separations between the sheet ingress and egress.

10 Claims, 3 Drawing Sheets

APPARATUS AND METHOD FOR COLLATING RANDOM ARRAYS OF SHEETS TO ORDERED STACKS

This is a Continuation of application Ser. No. 08/310,560, filed 22 Sep. 1994 abandoned.

FIELD OF INVENTION

The present invention relates to the collating of sheet form materials (e.g. paper, cardboard, film etc.), and more specifically to improved apparatus and methods for transporting, aligning and separating random arrays of seriatim sheets to effect well ordered stack collation of the sheets.

BACKGROUND OF INVENTION

There are many commercial processes wherein it is desired to collate random arrays of sheets into well ordered stacks. The automated production of consumer packages of photographic prints provides a good example. In such a process, prints are developed on sheets or strips of photographic paper, which are subsequently cut into a plurality of smaller sheet elements, e.g., each containing a single image. Even if guide and transport through the cutting system is highly accurate, the cutting operation can impart a disordered random arrangement to the army of cut sheets. That is, the cutting blades will precisely engage the multi-image strip, or sheet, to accurately separate the individual images; but the cutting forces, and/or separation from the cutter elements can disturb the ordered array of seriatim sheets into a random array, e.g., having relatively skewed elements, non-uniform inter-element spacings and/or element overlaps of various configurations. The element disorder of such random arrays present serious difficulties, when the goal is collation of sheet elements to form even edged, uniformly flat, sheet stacks.

For example, sheets that are skewed at the stage of entry into a stack collating bin, can jam on the bin edge guides. If such edge guides are omitted, the sheet can remain skewed and subsequently hinder the insertion of their stack into a customer envelope.

Also, such random arrays can have the tail end of a leading sheet overlapping the lead end of the next-trailing sheet, during transport to the stack bin. This situation can cause a jam at the sheet entry region (or perhaps a somersaulted, and thus upsidedown, sheet). Neither of these results is desirable.

U.S. Pat. Nos. 2,674,456 and 3,929,327 disclose sheet transporting devices that utilized transport rollers that are formed of a resilient material and have a frusto-conical shape. These rollers urge skewed documents, moving along a transport path, into an aligned condition against a guide rail that is orthogonal to the rollers axes of rotation and parallel to the direction of sheet transport. More specifically, the configuration of the rollers provides a force directing the sheet at a slight angle toward the guide rail and a torque that tends to twist the feed sheet until the entire sheet edge, adjacent the guide rail, abuts that rail. These systems work nicely to straighten feed sheets and align them during their transport; however, they do not answer the problems that evolve from sheet overlaps, and, therefore, are not a solution for achieving accurate stack-collation of random array sheets.

SUMMARY OF INVENTION

One significant purpose of the present invention is to provide improved apparatus and methods to obviate the problems outlined above and to effect ordered sheet outputs from sheet inputs comprising random, arrays of seriatim sheets.

Thus, in one aspect the present invention constitutes apparatus for orderingly feeding linear sheet arrays from feed path ingress to egress. The apparatus includes: (i) a support surface extending from ingress to egress, (ii) a plurality of spaced drive rollers constructed and located to move sheets passing thereunder, into edge alignment along a lateral edge guide, extending along the side of the feed path and (iii) drive means for rotating the drive rollers. The drive means and drive rollers are cooperatively constructed so that drive surfaces of rollers in successively downstream locations move respectively at successively higher peripheral velocities, so that sheets move through the feed path egress into an edge alignment and to have with an end space separations between successive sheets.

In another aspect the present invention constitutes a method for ordering linear sheet arrays and includes the steps of: (i) feeding sheets along a feed path and into edge alignment with a lateral edge guide along the path and (ii) successively overdriving the sheets respectively at successively downstream locations to separate the ends of adjacent sheets.

BRIEF DESCRIPTION OF DRAWINGS

The subsequent description of preferred embodiments of the invention is set forth with reference to the accompanying drawings wherein.

DETAILED DESCRIPTION OF THE INVENTION

Figure 1:
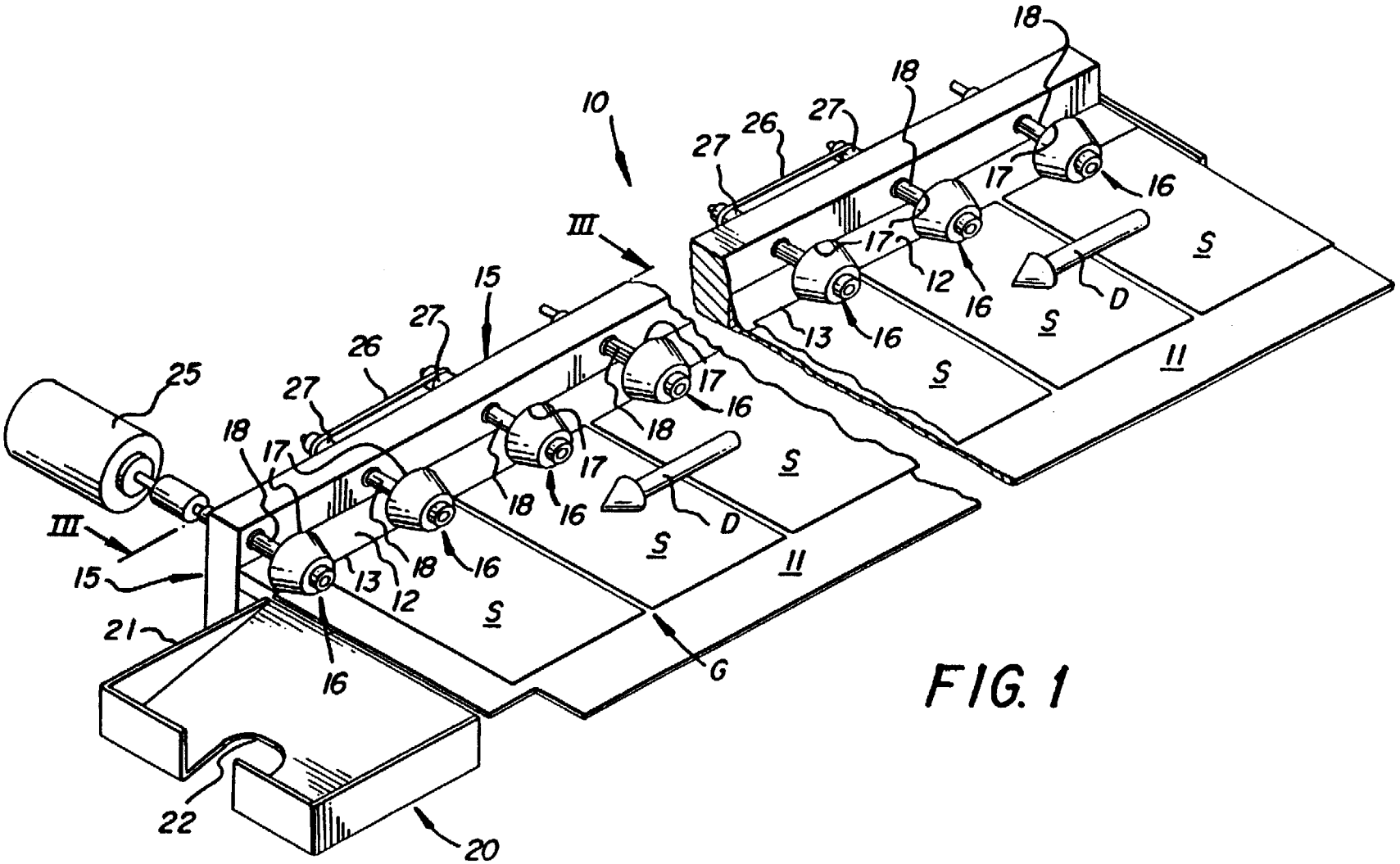
FIG. 1 is a perspective view schematically illustrating one preferred embodiment of the present invention.
Figure 5:
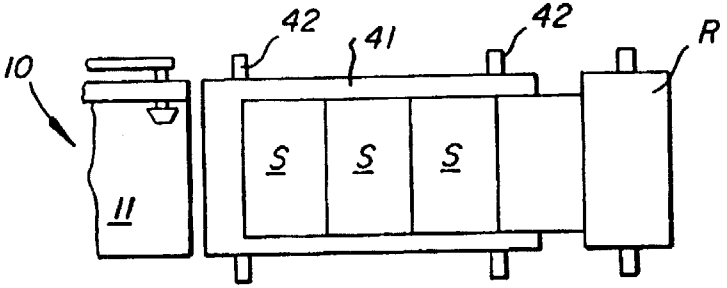
FIG. 5 is a schematic top view diagram illustrating a top view of exemplary input to the FIG. 1 apparatus.

Referring to FIG. 1, the apparatus, designated generally 10, is one preferred mechanism for effecting transfer, alignment and ordered stack collation of an array of seriatim sheets S supplied thereto. The sheets S can be fed onto planar support surface 11 of apparatus 10 by various systems. For example, as shown schematically in FIG. 5, a conveyor belt 41 driven on shafts 42, can receive strip outputs from a roll R of web material, such as photographic prints. The strip of web material is cut into discrete sheets S by one of various known devices (not shown) and belt 41 delivers the cut sheets onto support surface 11 of apparatus 10 in a random linear array (e.g., as described in the background section above).

As shown in FIG. 1, apparatus 10 further comprises a lateral edge guide 12 which has a guide surface 13 that is generally normal to support surface 11. Guide surface 13 is linear and preferably aligned with the desired stack edge position to be obtained during stack collation (in FIG. 1 such desired position could be adjacent the side wall 21 of collation bin 20).

The support surface 11 and edge guide 12 both extend from a portion of the main frame 15 of apparatus 10; and collation bin 20 can be mounted to the main frame 15, so that its bottom wall 22 slopes downwardly from support surface 11 to receive sheets, with the assistance of feed momentum and gravity.

In accord with the present invention, a plurality of predeterminedly constructed drive rollers 16 are mounted at predeterminedly spaced positions vis a vis the support surface 11 and edge guide 12 of apparatus 10. More particularly, drive rollers 16 have a frusto-conical configuration and are formed of a resilient material, e.g. urethane foam. One preferred roller construction is a urethane 20$_o$ conical roller sold by JFR Industries, 264 Turk Hill Road, Fairport, N.Y.

The conical edge drive rollers 16 are attached to drive shafts 18, mounted for rotation in wall of main frame 15, and extend so that their conical bases are opposite the guide surface 13 and their peripheral edge drive regions 17 make driving contact with sheets between support surface 11 and the rollers 16. Also in accord with the present invention, the location of rollers 16 is selected in accordance with the dimension (in the sheet feed direction D) of the sheets to be fed, so that the spacing between the roller/support surface nips is slightly less than the sheet feed dimension of the fed sheets. In this manner, drive is picked up by the next subsequent downstream rollers before sheets pass from the next upstream nips. However, in accord with the present invention, it is also important that each sheet S have significant periods, during feed along the path, wherein the sheet is under the influence of only one roller 16. The amount by which the roller spacing is less than the sheet feed dimension can vary depending on the degree which sheets need to be manipulated for end to end separation.

Figure 2:
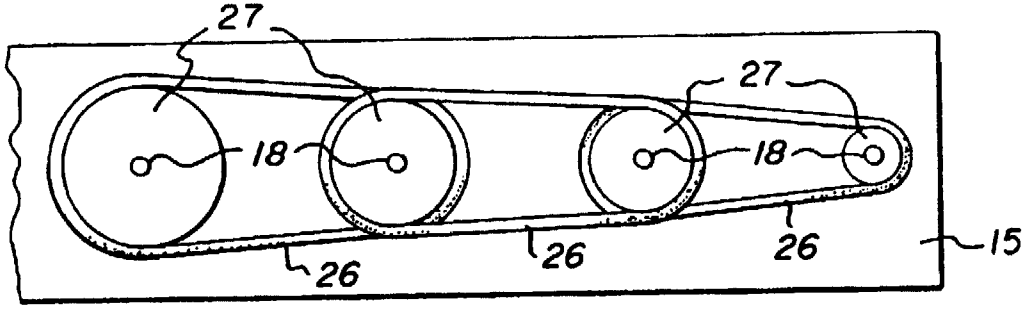
FIG. 2 is a side view of the FIG. 1 apparatus showing one preferred overdrive system according to the present invention.
Figure 3:
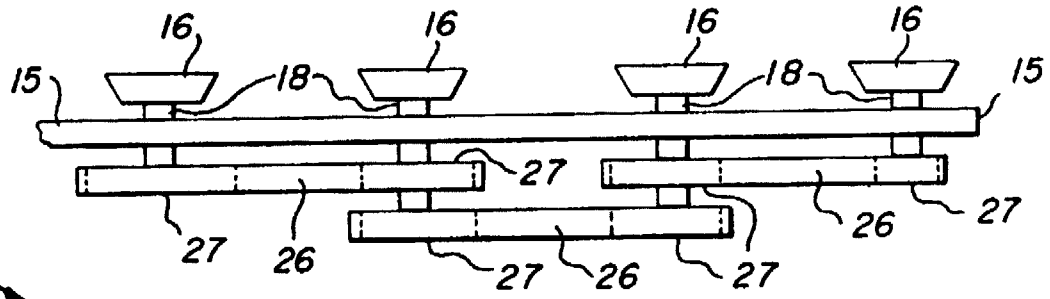
FIG. 3 is a top view of the system shown in FIG. 2.

The drive shafts 18 are each coupled to respective drive gears on the opposite side of main frame 15 from rollers 16. In the FIG. 1 embodiment, the drive gears for each shaft 18 are coupled to a drive motor 25 by a series of timing belts 26. The belt and gear drive system is constructed in a manner such that each successively upstream roller 16 is underdriven (i.e. rotates at a lesser angular velocity) relative to its adjacent downstream roller 16. In the FIG. 2 and 3 system this is achieved by the most downstream gear 27 having the smallest diameter and progressively upstream gears having progressively larger diameters.

Figure 4:
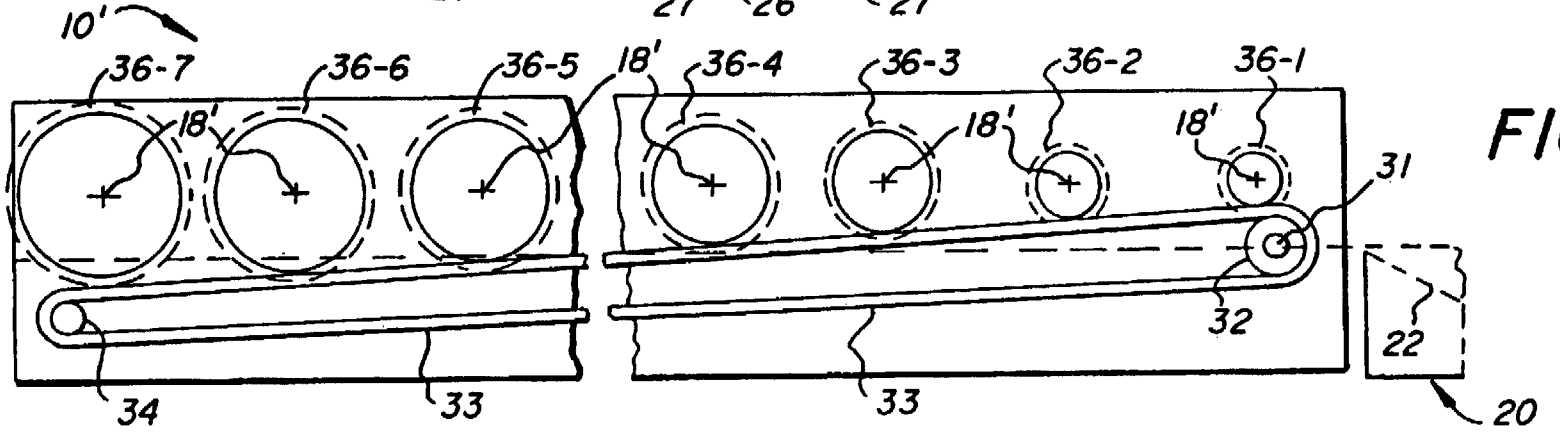
FIG. 4 is a side view similar to FIG. 2 showing another overdrive system for effecting the present invention.

Referring to FIG. 4, there is illustrated another preferred drive system for practice of the present invention. In this embodiment the motor 25 (shown in FIG. 1) provides drive, via shaft 31, to belt drive gear 32, in response, gear 32 drives an inner geared surface of a timing belt 33, mounted on the drive gear 32 and an idler gear 34. The outer surface of belt 33 is also geared and successively meshes with drive gears 36-1 through 36-7, which are coupled, via shafts 18, to successively upstream drive rollers, such as rollers 16 shown in FIG. 1. That is, gear 36-1, having the smaller diameter, is coupled to the most downstream roller 16, adjacent collator bin 20; and gear 36-7, having the largest diameter, is coupled to the most upstream roller 16 at the ingress to apparatus 10'. The diameters of gears 36-2, 36-3, 36-4, 36-5 and 36-6 increase in accordance with the further upstream position of their respective rollers, as shown in FIG. 4. It will be appreciated by one skilled in the art, that when the constant linear velocity belt meshes with the periphery of the varying degree gears 36, the shafts 18' will rotate with different velocities that vary inversely to gear diameter. Thus, the downstream roller coupled to gear 36-1 by shaft 18' will rotate faster than its upstream neighbor 36-2. This relation continues in the upstream direction to the ingress end of apparatus 10', where the drive roller, coupled to gear 36-7 leg shaft 18', rotates slower than its downstream neighbor, coupled to gear 36-6.

Figure 7:
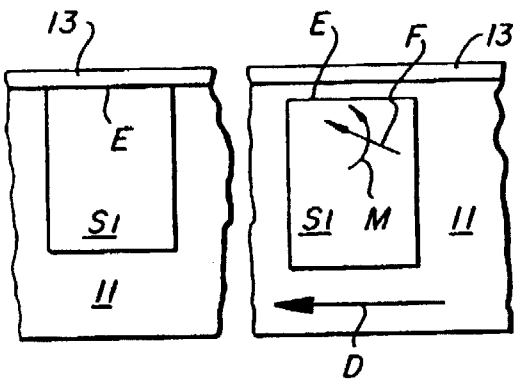
FIG. 7 is a diagram illustrating sheet aligning movements during operation of the FIG. 1 apparatus.

The functions of the individual mechanisms described above will become clearer by a description of the overall operation of apparatus 10. Thus, as the sheet elements S of a random array are introduced sequentially onto support surface 11, the lead sheet S passes into the nip formed by the first roller 16. The rotating edge drive region 17 of upstream roller 16 imparts a drive force vector F (looking down in FIG. 1, as schematically illustrated in FIG. 7), which force urging the sheet S towards guide surface 13. The rollers 16 also create a torque M, tending to rotate the sheet S originally counter clockwise until the sheet's top right corner touches the edge guide E. The guide then forces the sheet to rotate clockwise as the sheet moves forward and thus aligns the sheet edge E to the edge guide 13. A further explanation of the manner in which resilient, frusto-conical drive rollers exert such forces is set forth in U.S. Pat. No. 3,929,327, which is incorporated by reference as to these teachings. The result of the succession of rollers 16 acting on sheets S with forces F and moments M, is to move each sheet into a condition with its edge E, which is adjacent guide surface 13, fully aligned in abutting relation to the surface 13, as shown in the downstream sheet position of FIG. 7.

Figure 8:
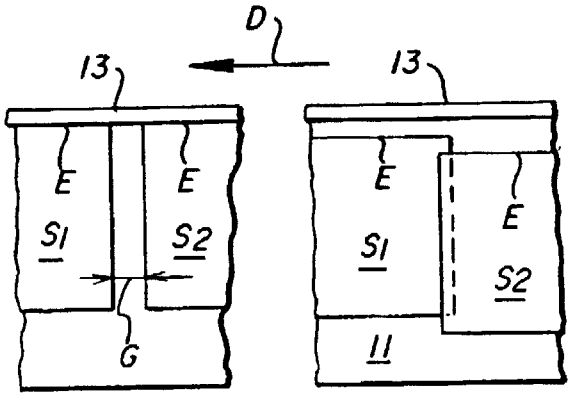
FIGS. 8 and 9 are diagrams illustrating the advantageous sheet separating and aligning effects of the present invention.
Figure 9:
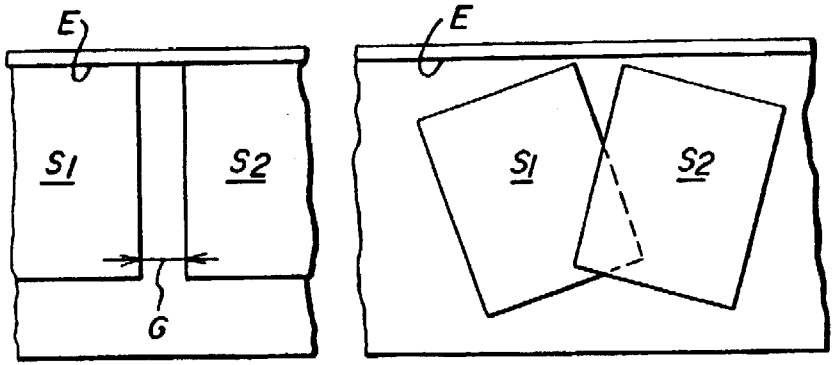

In addition to the lateral shifting into alignment on surface 13, the progressive actions of rollers 16 effect a separation between successive sheets. As explained above, each roller 16 rotates with a drive region velocity higher than its upstream neighbor (and lower than its downstream neighbor). During the period when a sheet S is solely under the influence of a downstream roller, it advances faster than the next upstream sheet, which is under the influence of the adjacent upstream drive roller. This causes a continually increasing displacement between successive sheets, separates them along the direction of the feed path, as schematically illustrated in FIGS. 8 and 9. It will be appreciated that this separating action will occur even in instances where successive sheet ends overlap or underlap one another. As shown in FIGS. 8 and 9, when an adjacent end of upstream sheet $S_2$ overlaps the adjacent end of downstream sheet S, apparatus 10 will provide a gap G between S and $S_2$, as well as aligning the edges E of each along surface 13. Thus, the succession of rollers 16, being respectively overdriven (rotated at a higher angular velocity) in the relative downstream direction provides the necessary separation to a disordered sheet array so that ordered collation can occur on the sheets arrival at the collation bin 20. With the sheets abutting against linear guide surface 13, which is aligned with the desired slack edge position in bin 20, and separated to have a gap G between adjacent sheets, the sheets S will move into bin 20 in well ordered stack collation to achieve the purposes of the invention.

Figure 6:
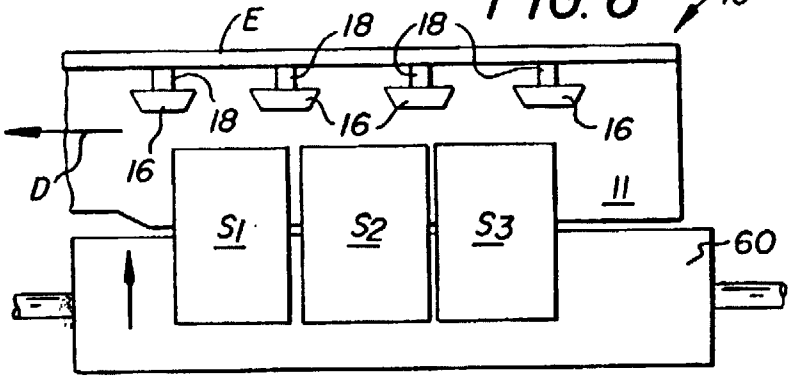
FIG. 6 is a schematic top view showing another preferred method of sheet input to the FIG. 1 apparatus.

It will be appreciated that other drive roller constructions can be provided to urge sheets S into alignment on surface 13. Also, other constructions can be provided to achieve relative downstream overdrive of sheets. For example, the rollers 16 can be driven at the same shaft (angular) velocity, but themselves have different diameters to effect different drive region peripheral velocities in accord with the invention. Also, the apparatus of the present invention can accommodate different modes of sheet input. As shown in FIG. 6, a roller drive 60 can transport cut sheets $S_1$–$S_3$ in tandem into the nips between rollers 16 and surface 11 from an input direction I that is orthogonal to the feed direction D of apparatus 10. Various other input modes are useful.

The invention has been described with particular reference to preferred embodiments thereof, but it will be understood that variations and modifications can be effected within the spirit and scope of the invention.

We claim:

1. Sheet collation apparatus for transporting and ordering, along a feed path, supplied from a random array of seriatim sheets, each sheet having a length (l) measured along the feed path, said apparatus comprising:

a. a sheet support surface extending from such sheet path ingress to egress;

b. a linear sheet edge guide extending along an edge of said support surface, said edge guide being linear and aligned with a desired stack edge position at said egress; and c. a plurality of sheet drive means, located along said feed path at spacings slightly less than length (l) of such sheets, for simultaneously edge aligning and end separating the sheets of such array, said sheet drive means comprising a plurality of conical roller surfaces, each conical roller surface rotating at a faster angular velocity than a preceding one.

2. Apparatus for transporting and ordering a random array of seriatim sheets from a feed path ingress to a feed path egress, said apparatus comprising:

a. a sheet support surface extending from said ingress to said egress;

b. a lateral sheet edge guide generally normal to said support surface, said edge guide being linear and aligned with a stack edge position at said feed path egress;

c. a plurality of drive rollers constructed and located in spaced relation along said path so as, during rotation, to move sheets passing thereunder into edge alignment along said edge guide; and d. drive means for rotatively driving said rollers; said drive means and said drive rollers being cooperatively constructed so that drive surfaces of rollers in successively downstream locations move respectively at successively higher peripheral velocity whereby sheets move along said feed path and simultaneously into edge alignment and to have end spaced separations between successive sheets.

3. The invention defined in claim 2 wherein said rollers are formed of resilient material, have a drive surface of frusto-conical configuration and are located with their conical bases opposite said edge guide.

4. The invention defined in claim 3 wherein said rollers are formed of foam material.

5. The invention defined in claim 2 wherein said drive means comprises motor means and a gear system for driving successive downstream rollers at successively faster angular velocities.

6. The invention defined in claim 2 further comprising a stack-collator located at said feed path egress and having: (i) a stack edge guide aligned with said sheet edge guide and (ii) a stack support surface extending angularly downward from said sheet support surface.

7. A method of ordering linear sheet arrays, said method comprising;

a. feeding sheets of such arrays along a feed path and into edge abutment with a lateral edge alignment guide located in a predetermined position along a side of said path, said feeding further comprising rotating peripheral sectors of resilient, frustoconical rollers into contact with sheets passing thereunder on a sheet support surface; and b. successively overdriving said sheets respectively at successively downstream locations to separate the ends of adjacent sheets.

8. The method of claim 7 wherein said overdriving step comprises rotating the peripheral sectors of successively downstream rollers at successively higher peripheral velocities.

9. The method defined in claim 7 wherein the sheets of such arrays are input to said path in a direction orthogonal to said feeding.

10. The method defined in claim 9 wherein said sheets are input at the nip between an edge of a conical roller and a support surface.

* * * * *